US007157673B2

(12) United States Patent
Samei et al.

(10) Patent No.: US 7,157,673 B2
(45) Date of Patent: Jan. 2, 2007

(54) IMAGE HEATING APPARATUS

(75) Inventors: Masahiro Samei, Toyonaka (JP); Tomoyuki Noguchi, Kasuga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/076,937

(22) Filed: Mar. 11, 2005

(65) Prior Publication Data

US 2005/0199613 A1 Sep. 15, 2005

(30) Foreign Application Priority Data

Mar. 12, 2004 (JP) ..... 2004-070261
Mar. 25, 2004 (JP) ..... 2004-089767

(51) Int. Cl.
*H05B 1/00* (2006.01)
*H05B 6/14* (2006.01)
*B21B 27/06* (2006.01)

(52) U.S. Cl. ..... 219/619; 219/469; 219/216

(58) Field of Classification Search ..... 219/619, 219/618, 600, 469, 216
See application file for complete search history.

(56) References Cited

U.S. PATENT DOCUMENTS 5,660,750 A * 8/1997 Kusaka ..... 219/216
6,009,300 A * 12/1999 Kagawa et al. ..... 399/333
6,223,017 B1 * 4/2001 Akutsu et al. ..... 399/330
6,313,448 B1 * 11/2001 Johnson ..... 219/633
6,567,641 B1 * 5/2003 Aslam et al. ..... 399/330
6,643,491 B1 * 11/2003 Kinouchi et al. ..... 399/330
6,803,549 B1 * 10/2004 Yu ..... 219/619
6,849,836 B1 * 2/2005 Yu ..... 219/619

FOREIGN PATENT DOCUMENTS

JP 2000-215973 8/2000
JP 2003-347032 12/2003

OTHER PUBLICATIONS

English Language Abstract of JP 2003-347032.
English Language Abstract of JP 2000-215973.

* cited by examiner

*Primary Examiner*—Daniel Robinson
(74) *Attorney, Agent, or Firm*—Greenblum & Bernstein, P.L.C.

(57) ABSTRACT

The present invention provides an induction heating apparatus including a fixing belt that heats an unfixed image on recording paper, an excitation coil that induction-heats the fixing belt, an inverter circuit that supplies power to the excitation coil, a harness that electrically connects the excitation coil and the inverter circuit. The harness is constructed of a litz wire having a resistance of the harness section of 0.016 Ω or below formed by stranding several tens of wires which are conductive wires coated with an insulator into a predetermined thickness.

15 Claims, 9 Drawing Sheets

| | LENGTH OF HARNESS SECTION (FOR TWO WIRES) | WIRE DIAMETER [m] | CROSS-SECTIONAL AREA OF WIRE [$m^2$] | NUMBER OF WIRES | CROSS-SECTIONAL AREA OF HARNESS SECTION [$mm^2$] | WIRE SPECIFIC RESISTANCE [Ωm] | RESISTANCE OF HARNESS SECTION [Ω] | HARNESS EFFECTIVE CURRENT VALUE [A] (1200W OUTPUT) | LOSS OF HARNESS SECTION [W] | LOSS REDUCTION EFFECT [W] | TIME FOR RISE FROM 20°C TO 170°C [s] (WARM-UP TIME) | WARM-UP TIME REDUCTION EFFECT [%] |
|---|---|---|---|---|---|---|---|---|---|---|---|---|
| CONVENTIONAL EXAMPLE | 1.2 | $150\times10^{-6}$ | $1.77\times10^{-8}$ | 40 | $7.07\times10^{-7}$ | $1.81\times10^{-8}$ | 0.031 | 23.2 | 16.5 | - | 15.5 | - |
| THIS EMBODIMENT | 1.2 | $150\times10^{-6}$ | $1.77\times10^{-8}$ | 160 | $2.83\times10^{-6}$ | $1.81\times10^{-8}$ | 0.008 | 23.2 | 4.1 | 1.24 | 14.1 | 9.0% |

| | LENGTH OF HARNESS SECTION (FOR TWO WIRES) | WIRE DIAMETER [m] | CROSS-SECTIONAL AREA OF WIRE [$m^2$] | NUMBER OF WIRES | CROSS-SECTIONAL AREA OF HARNESS SECTION [$mm^2$] | WIRE SPECIFIC RESISTANCE [Ωm] | RESISTANCE OF HARNESS SECTION [Ω] | HARNESS EFFECTIVE CURRENT VALUE [A] (1200W OUTPUT) | LOSS OF HARNESS SECTION [W] | LOSS REDUCTION EFFECT [W] | TIME FOR RISE FROM 20℃ TO 170℃ [s] (WARM-UP TIME) | WARM-UP TIME REDUCTION EFFECT [%] |
|---|---|---|---|---|---|---|---|---|---|---|---|---|
| CONVENTIONAL EXAMPLE | 1.2 | $150\times10^{-6}$ | $1.77\times10^{-8}$ | 40 | $7.07\times10^{-7}$ | $1.81\times10^{-8}$ | 0.031 | 23.2 | 16.5 | - | 15.5 | - |
| THIS EMBODIMENT | 1.2 | $150\times10^{-6}$ | $1.77\times10^{-8}$ | 160 | $2.83\times10^{-6}$ | $1.81\times10^{-8}$ | 0.008 | 23.2 | 4.1 | 1.24 | 14.1 | 9.0% |

FIG. 6

IMAGE HEATING APPARATUS

BACKGROUND OF THE INVENTION

1. Field of the Invention

The present invention relates to an image heating apparatus based on an induction heating scheme which heats an unfixed image on a recording medium, and more particularly, to an image heating apparatus effectively applicable to a fixing apparatus for an image formation apparatus such as a copier, facsimile and printer based on an electrophotography scheme or electrostatic recording scheme.

2. Description of the Related Art

As a heating section of an image heating body which heats/fixes an unfixed image on a recording medium such as transfer paper and an OHP (Over Head Projector) sheet, an image heating apparatus based on an induction heating (IH; induction heating) scheme is known.

This image heating apparatus based on an IH scheme generates an eddy current by causing a magnetic field generated by a magnetic field generation section to act on the image heating body and heats/fixes an unfixed image on a recording medium by the image heating body Joule-heated by this eddy current.

The IH-scheme image heating apparatus has the advantages of having a higher heat-generating efficiency than an image heating apparatus using a halogen lamp as a heat source of a heating section which heats the image heating body and being able to shortening a warm-up time. Furthermore, the image heating apparatus using a thin sleeve or belt, etc., as the image heating body has a smaller heat capacity of the image heating body, and can thereby cause the image heating body to generate heat in a short time and improve rising response at the startup considerably.

The magnetic field generation section of this IH-scheme image heating apparatus is constructed of a core made of ferrite or permalloy, an excitation coil wound around the image heating body and a power supply unit which supplies a high frequency current to the excitation coil, etc. The power supply unit is constructed of an inverter circuit, etc., as a feeder circuit that supplies power to a power supply circuit and the excitation coil.

However, in order to avoid misoperation due to overheat, the power supply unit is required to be cooled by a cooling fan, etc., and placed at a position as far as possible from a heat source.

On the other hand, the image heating body is required to be located at a place where it is hardly affected by outside air so that the heating temperature does not become unstable due to cool air, etc., from the cooling fan or the warm-up time is not extended. In order to perform image fixing which is the final step of image formation, the image heating body is inevitably disposed in the vicinity of an ejection port of a recording medium.

Thus, this type of image heating apparatus generally disposes the power supply unit at a place as far as possible from the image heating body so as to supply power from the inverter circuit to the excitation coil through a harness (feeder) (e.g., see Unexamined Japanese Patent Publication No. 2003-347032).

However, the conventional image heating apparatus has a problem that the warm-up time takes a longer time than a time estimated from various preset conditions.

Thus, when the causes for such a problem were investigated, it was discovered that the problem was caused by the harness which electrically connects the excitation coil and the inverter circuit.

That is, as described above, this type of image heating apparatus arranges the power supply unit as far as possible from the image heating body, which causes the length of harness for supplying power to the excitation coil to increase.

Furthermore, since the conventional image heating apparatus extends a litz wire of the coil section of the excitation coil as the harness section as is, the same litz wire as the litz wire of the coil section is used. As the litz wire of the coil section of this excitation coil, a thin litz wire consisting of approximately 40 wires is normally used to increase the number of windings.

However, with such a litz wire with a reduced number of wires, the resistance increases in proportion to the length and a power loss during power supply increases. Such a loss in the litz wire causes the heating efficiency of the image heating body to reduce.

For these reasons, the image heating apparatus using the litz wire as the harness section has a problem that the warm-up time becomes longer than the time estimated from various predetermined conditions.

SUMMARY OF THE INVENTION

It is an object of the present invention to provide an image heating apparatus capable of suppressing a loss in a harness section which supplies power to an excitation coil due to the resistance of the harness section.

The present invention uses, as a harness that electrically connects an excitation coil which induction-heats an image heating body and a feeder circuit which supplies power to the excitation coil, a conductive wire preset so that a power loss during a power supply is reduced compared to a case where the same material as that of the excitation coil is used under the same condition.

Furthermore, the present invention also uses, as a harness that electrically connects an excitation coil which induction-heats an image heating body and a feeder circuit which feeds power to the excitation coil, a conductive wire which is the same material as that of the excitation coil and whose cross section is set to be larger than that of the excitation coil.

As the harness that electrically connects an excitation coil which induction-heats an image heating body and a feeder circuit which supplies power to the excitation coil, the present invention preferably uses a conductive wire having a harness section resistance of 0.016 Ω or below.

Furthermore, as the harness that electrically connects an excitation coil which induction-heats an image heating body and a feeder circuit which supplies power to the excitation coil, the present invention preferably uses a conductive wire having a length of the harness section of 0.6 m or below and a harness section cross-sectional area of $1.41\times10^{-6}$ or above.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which;

FIG. 6 illustrates a comparison of various parameters between the harness used by the induction heating apparatus of the image heating apparatus according to Embodiment 1 of the present invention and a harness of a conventional example;

DETAILED DESCRIPTION OF THE PREFERRED EMBODIMENTS

With reference now to the attached drawings, embodiments of the present invention will be explained in detail below.

Embodiment 1

Figure 1:
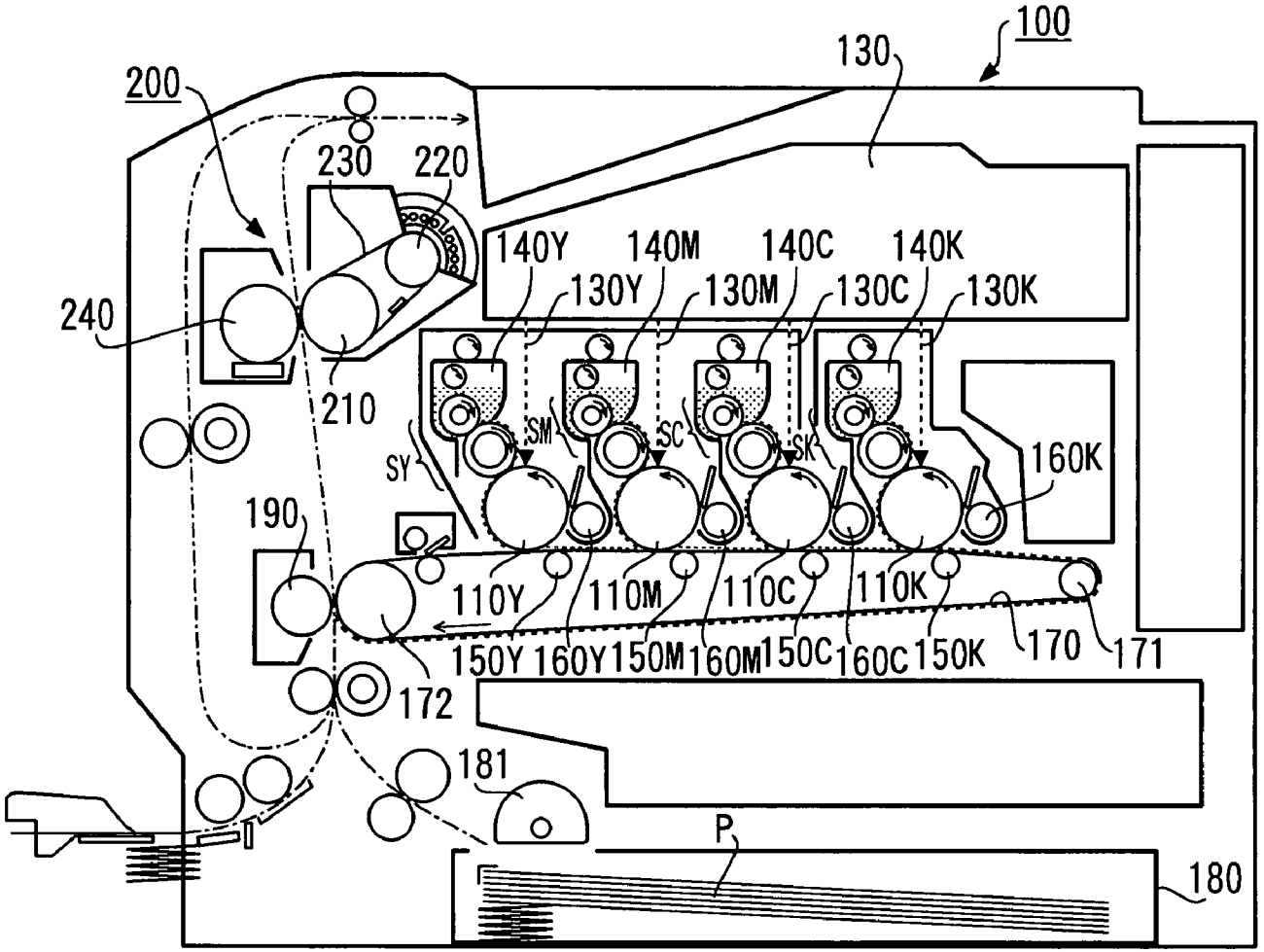
FIG. 1 is a schematic cross-sectional view showing the configuration of an image formation apparatus using an image heating apparatus according to Embodiment 1 of the present invention as a fixing apparatus.

FIG. 1 is a schematic cross-sectional view showing the configuration of an image formation apparatus using an image heating apparatus according to Embodiment 1 of the present invention as a fixing apparatus. The image formation apparatus 100 shown in FIG. 1 is an image formation apparatus based on a 1-path scheme. In the image formation apparatus 100, toner images of four colors contributing to the coloring of a color image are individually formed on four image carriers, primary-transferred onto an intermediate transfer body overlapped on one another sequentially and then these primary transfer images are collectively transferred (secondary transfer) to a recording medium.

It goes without saying that the image heating apparatus according to this Embodiment 1 is not limited to only the 1-path scheme image formation apparatus, but can be mounted on all types of image formation apparatus.

In FIG. 1, suffixes Y, M, C, K of reference numerals assigned the respective components of the image formation apparatus 100 denote components involved in image formation such as; Y: yellow image, M: magenta image, C: cyan image; K: black image, and components of the same reference numeral have a common configuration.

The image formation apparatus 100 includes photosensitive drums 110Y, 110M, 110C, 110K as the four image carriers and an intermediate transfer belt (intermediate transfer body) 170. There are image formation stations SY, SM, SC, SK around the respective photosensitive drums 110Y, 110M, 110C, 110K.

The image formation stations SY, SM, SC, SK are constructed of electrifiers (not shown), a photolithography machine 130, developing machines 140Y, 140M, 140C, 140K, transfer machines 150Y, 150M, 150C, 150K and cleaning apparatuses 160Y, 160M, 160C, 160K.

In FIG. 1, the respective photosensitive drums 110Y, 110M, 110C, 110K are rotated in a direction indicated by the respective arrows. The surfaces of the respective photosensitive drums 110Y, 110M, 110C, 110K are charged uniformly to a predetermined potential by the electrifiers.

The surfaces of the respective photosensitive drums 110Y, 110M, 110C, 110K are irradiated with scanning lines 130Y, 130M, 130C, 130K of laser beams corresponding to image data of specific colors by the photolithography machine 130. In this way, electrostatic latent images for the corresponding specific colors are formed on the surfaces of the respective photosensitive drums 110Y, 110M, 110C, 110K.

The electrostatic latent images for the corresponding specific colors formed on the photosensitive drums 110Y, 110M, 110C, 110K are converted to visible images by the developing machines 140Y, 140M, 140C, 140K. In this way, unfixed images of four colors which contribute to the coloring of color images are formed on the respective photosensitive drums 110Y, 110M, 110C, 110K.

The toner images of four colors visualized on the photosensitive drums 110Y, 110M, 110C, 110K are primary-transferred to an endless intermediate transfer belt 170 as intermediate transfer bodies by the transfer machines 150Y, 150M, 150C, 150K. This causes the toner images of four colors formed on the photosensitive drums 110Y, 110M, 110C, 110K to be superimposed on one another sequentially, forming a full color image on the intermediate transfer belt 170.

After the photosensitive drums 110Y, 110M, 110C, 110K have transferred the toner images to the intermediate transfer belt 170, the cleaning apparatuses 160Y, 160M, 160C, 160K remove the residual toner remaining on their respective surfaces.

Here, the photolithography machine 130 is disposed with a predetermined angle with respect to the photosensitive drums 110Y, 110M, 110C, 110K. Furthermore, the intermediate transfer belt 170 is put round the driving roller 171 and driven roller 172 and rotated in a direction indicated by an arrow in FIG. 1 as the driving roller 171 rotates.

On the other hand, a feed cassette 180 housing recording paper P such as printing paper as a recording medium is provided in the lower part of the image formation apparatus 100. The recording paper P is fed one sheet after another from the feed cassette 180 by a feed roller 181 along a predetermined sheet route.

The recording paper P sent out into the sheet route passes through a transfer nip section formed of the outer surface of the intermediate transfer belt 170 put round the driven roller 172 and a secondary transfer roller 190 which contacts the outer surface of the intermediate transfer belt 170. A full color image (unfixed image) formed on the intermediate transfer belt 170 is collectively transferred to the recording paper P by the secondary transfer roller 190 when the recording paper P passes through the transfer nip section.

Figure 2:
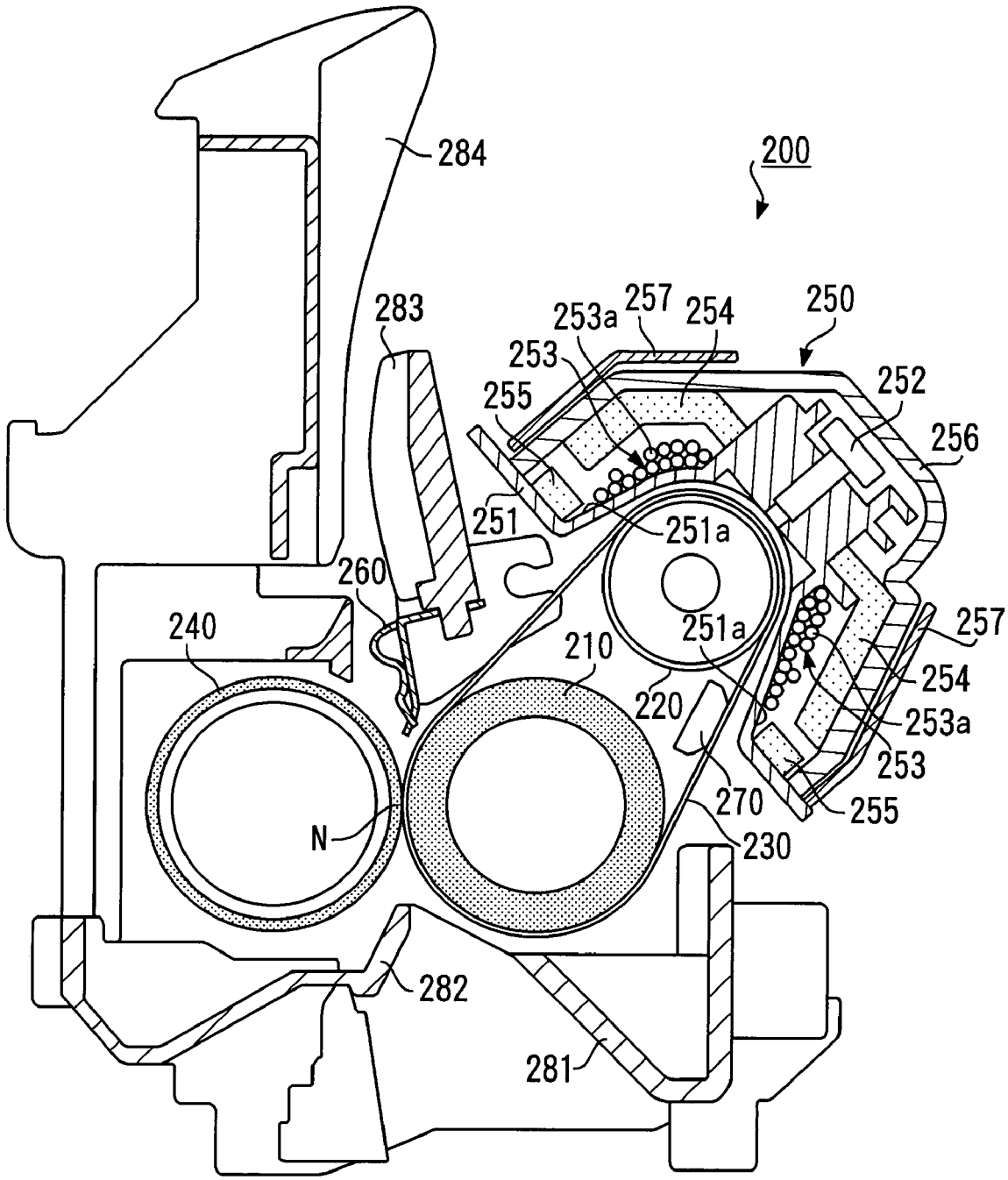
FIG. 2 is a schematic cross-sectional view showing the configuration of the fixing apparatus.

Then, the recording paper P passes through a fixing nip section N formed of the outer surface of a fixing belt 230 which is put round a fixing roller 210 and a heat generating roller 220 of a fixing apparatus 200 which will be detailed in FIG. 2 and a pressurizing roller 240 which contacts the outer surface of the fixing belt 230. This causes an unfixed full color image which has been collectively transferred by the transfer nip section to be heated and fixed to the recording paper P.

Next, the fixing apparatus mounted on the image formation apparatus 100 will be explained. FIG. 2 is a schematic cross-sectional view showing the configuration of a fixing apparatus using the image heating apparatus according to Embodiment 1 of the present invention.

This fixing apparatus uses an image heating apparatus based on an induction heating (IH) scheme as the image heat generation section. As shown in FIG. 2, the fixing apparatus 200 is provided with the fixing roller 210, the heat generating roller 220 as a heat generating body and the fixing belt 230 as an image heating body, etc. Furthermore, the fixing apparatus 200 is also provided with a pressurizing roller 240, an induction heating apparatus 250 as a heat generation unit, a separator 260 as a sheet separation guide plate and sheet guide plates 281, 282, 283, 284 as sheet transfer route formation members, etc.

The fixing apparatus 200 heats the heat generating roller 220 and fixing belt 230 through an action of a magnetic field generated by the induction heating apparatus 250. The fixing apparatus 200 heats/fixes the unfixed image on the recording paper P transferred along the sheet guide plates 281, 282, 283, 284 through the fixing nip section (N) between the heated fixing belt 230 and pressurizing roller 240.

The fixing apparatus using the image heating apparatus according to this Embodiment 1 may also be constructed in such a way that the fixing roller 210 also serves as the heat generating roller 220 and this fixing roller 210 directly heats/fixes the unfixed image on the recording paper P without using the fixing belt 230. Furthermore, it goes without saying that a halogen lamp, etc., can also be used as a heat source as the heating section.

In FIG. 2, the heat generating roller 220 is constructed of a body of rotation made of a hollow cylindrical magnetic metal member such as iron, cobalt, nickel or an alloy of these metals, etc. The heat generating roller 220 is supported at both ends in a rotatable manner by bearings fixed to support side plates (not shown) and rotated/driven by a driving section (not shown). Furthermore, the heat generating roller 220 has a structure with an outer diameter of 20 mm, a thickness of 0.3 mm, a low heat capacity, a quick temperature rise and adjusted to have a Curie point of 300° C. or more.

The fixing roller 210 consists of a core metal made of stainless steel, etc., coated with a solid or foaming and heat-resistant elastic member made of silicon rubber. The fixing roller 210 has an outer diameter of approximately 30 mm which is greater than the outer diameter of the heat generating roller 220. The elastic member has a thickness of approximately 3 to 8 mm and hardness of 15 to 50° (Asker hardness: 6 to 25° according to JIS A hardness).

Furthermore, the pressurizing roller 240 contacts the fixing roller 210 under pressure. This contact under pressure between the fixing roller 210 and pressurizing roller 240 causes a fixing nip section (N) of a predetermined width to be formed in the pressure contact area.

The fixing belt 230 consists of a heat-resistant belt put round between the heat generating roller 220 and fixing roller 210. With the heat generating roller 220 induction-heated by the induction heating apparatus 250, which will be described later, the heat of the heat generating roller 220 is transmitted to the fixing belt 230 in the contact area and the total circumference of the belt is heated as the heat generating roller 220 rotates.

In the fixing apparatus 200 structured as above, since the heat capacity of the heat generating roller 220 is smaller than the heat capacity of the fixing roller 210, the heat generating roller 220 is heated rapidly and this shortens the warm-up time at the start of heating and fixing.

The fixing belt 230 is constructed of a heat-resistant belt having a multilayered structure consisting of a heat generating layer, elastic layer and mold release layer. The heat generating layer uses as a base material, for example, magnetic metal such as iron, cobalt, nickel or an alloy using those metals as base materials. The elastic layer is made of an elastic member such as silicon rubber or fluorine rubber provided so as to cover the surface of the heat generating layer. The mold release layer is formed of resin or rubber with excellent mold-releasing properties such as PTFE, PFY, FEP, silicon rubber or fluorine rubber singly or as a mixture thereof.

Even if a foreign matter enters between the fixing belt 230 and heat generating roller 220 for some reason and a gap is produced there, the fixing belt 230 structured as above can induction-heat the heat generating layer through the induction heating apparatus 250 and heat the fixing belt itself. Thus, the fixing belt 230 can directly heat itself through the induction heating apparatus 250, which improves the heating efficiency, increases the speed of response and improves reliability as the heating/fixing unit with a reduced temperature variation.

The pressurizing roller 240 is constructed of a heat-resistant elastic member with high toner mold-releasing properties provided on the surface of a metal core made of a highly thermal conductive, metallic cylindrical member of copper or aluminum, etc. As the core metal, SUS may also be used in addition to the above described metals.

As described above, the pressurizing roller 240 forms the fixing nip section N which carries the recording paper P sandwiched through its pressure contact with the fixing roller 210 by the medium of the fixing belt 230. In the fixing apparatus 200 shown in the figure, the fixing nip section (N) is formed by making the pressurizing roller 240 harder than the fixing roller 210 so that the outer surface of the pressurizing roller 240 is pressed into the outer surface of the fixing roller 210 by the medium of the fixing belt 230.

For this reason, though the outer diameter the pressurizing roller 240 is approximately 30 mm, the same as that of the fixing roller 210, the thickness is approximately 2 to 5 mm, which is thinner than the fixing roller 210 and has hardness of approximately 20 to 60° (Asker hardness: 6 to 25° according to JIS A hardness), which is harder than the fixing roller 210.

In the fixing apparatus 200 structured as above, the recording paper P is carried sandwiched by the fixing nip section (N) so as to move along the surface shape of the outer surface of the pressurizing roller 240, which produces the effect that the heating/fixing surface of the recording paper P is likely to separate from the surface of the fixing belt 230.

A temperature detector 270 made of a thermo-sensitive device with quick thermal response such as a thermistor is placed in contact with the inner surface of the fixing belt 230 in the vicinity of the entrance of the fixing nip section (N) as a temperature detection section.

The induction heating apparatus 250 performs control based on the temperature of the inner surface of the fixing belt 230 detected by the temperature detector 270 in such a way that the heating temperature of the heat generating roller 220 and fixing belt 230, that is, the image fixing temperature of the unfixed image is kept to a predetermined temperature.

Figure 3:
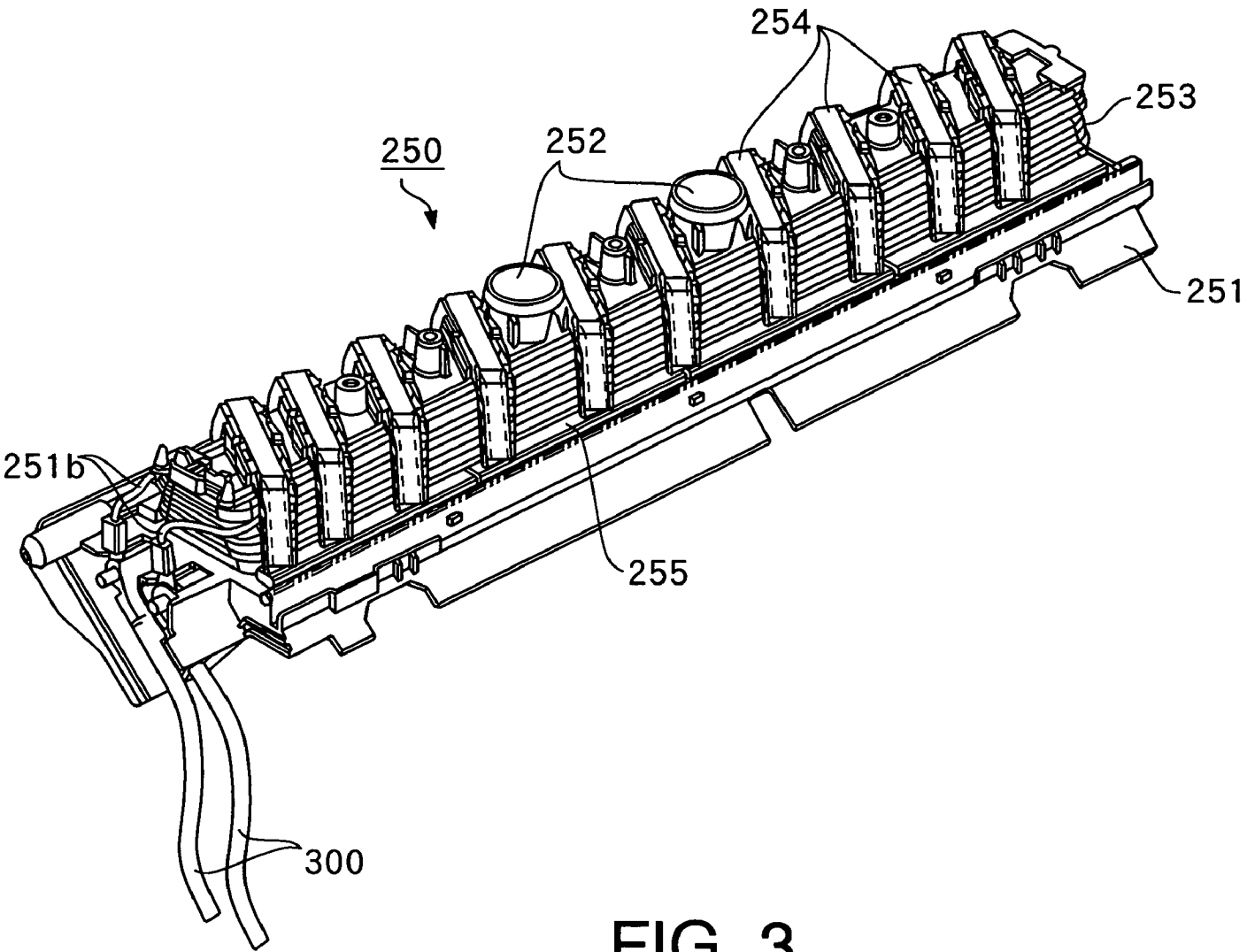
FIG. 3 is a perspective view showing the configuration of an induction heating apparatus of the fixing apparatus.

Next, the configuration of the induction heating apparatus 250 will be explained. FIG. 3 is a perspective view showing the configuration of the induction heating apparatus 250. As shown in FIG. 2 and FIG. 3, the induction heating apparatus 250 is disposed so as to face the outer surface of the heat generating roller 220 by the medium of the fixing belt 230. The induction heating apparatus 250 is provided with a support frame 251 made of flame-retardant resin which is curved so as to cover the heat generating roller 220 as a coil guide member.

In the central part of the support frame 251, thermostats 252 are disposed in such a way that the temperature detection sections are partially exposed from the support frame 251 toward the heat generating roller 220 and fixing belt 230.

When it is detected that the temperature of the heat generating roller 220 and fixing belt 230 has reached an abnormally high temperature, the thermostat 252 forcibly breaks the connection between an excitation coil 253 wound around the outer surface of the support frame 251 and an inverter circuit 400 (see FIG. 4) as a feeder circuit that supplies power to the excitation coil 253.

The excitation coil 253 is constructed by alternately winding a litz wire formed by stranding a plurality of surface-insulated wires along the support frame 251 in the axial direction of the heat generating roller 220. The length of this winding section of the excitation coil 253 is set to be substantially the same as the length of the area where the fixing belt 230 contacts the heat generating roller 220.

Figure 4:
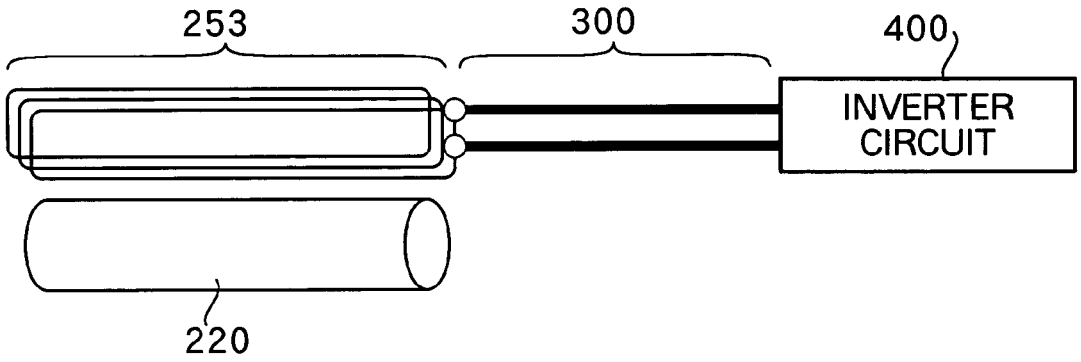
FIG. 4 illustrates a connection between the excitation coil of the induction heating apparatus and the inverter circuit.

Furthermore, as shown in FIG. 3 and FIG. 4, the excitation coil 253 is electrically connected to the inverter circuit 400 through a harness 300 as a feeder made of litz wire. This excitation coil 253 generates an alternating magnetic field by being supplied with a high-frequency alternating current of 10 kHz to 1 MHz (preferably 20 kHz to 800 kHz) from the inverter circuit 400 via the harness 300.

This alternating magnetic field acts on the heat generating layers of the heat generating roller 220 and fixing belt 230 in the contact area between the heat generating roller 220 and fixing belt 230 and in the vicinity thereof. The action of this alternating magnetic field causes an eddy current to flow inside the heat generating layer of the fixing belt 230 in a direction preventing any variation of the alternating magnetic field.

This eddy current produces Joule heat according to the resistance of the heat generating layers of the heat generating roller 220 and fixing belt 230 and principally induction-heats the heat generating roller 220 and fixing belt 230 in the contact area between the heat generating roller 220 and fixing belt 230 and in the vicinity thereof.

On the other hand, the support frame 251 is provided with arch cores 254 and side cores 255 so as to surround the excitation coil 253. These arch cores 254 and side cores 255 increase inductance of the excitation coil 253 and improve electromagnetic coupling between the excitation coil 253 and heat generating roller 220.

Therefore, the actions of the arch cores 254 and side cores 255 of this fixing apparatus 200 allow even a same coil current to supply more power to the heat generating roller 220 and can shorten the warm-up time.

Furthermore, the support frame 251 is provided with a roof-shaped resin housing 256 formed so as to cover the arch cores 254 and thermostats 252 inside the induction heating apparatus 250. A plurality of heat radiation holes is formed in this housing 256 so that heat generated from the support frame 251, excitation coil 253 and arch cores 254, etc., radiates out. The housing 256 may also be formed of any material other than resin such as aluminum.

Furthermore, the support frame 251 is provided with a short ring 257 that covers the outer surface of the housing 256 in such a way as not to block the heat radiation holes formed in the housing 256. The short ring 257 is disposed on the back of the arch core 254. In the short ring 257, an eddy current is generated in a direction canceling slight leaked magnetic flux which leaks outward from the back of the arch cores 254, producing a magnetic field in a direction canceling the magnetic field of the leaked magnetic flux to thereby prevent unnecessary radiation.

Figure 5:
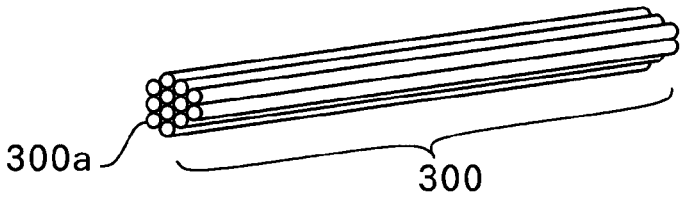
FIG. 5 is a partial perspective view of a harness that connects the excitation coil and inverter circuit.

On the other hand, as described above, the conventional image heating apparatus uses the same litz wire as the litz wire of the coil section of the excitation coil 253 as the harness 300 which supplies power to the excitation coil 253 of the induction heating apparatus 250. This litz wire is obtained, for example, by stranding several tens of wires 300*a* which are conductive wires such as enamel wires coated with an insulator to a predetermined thickness as shown in FIG. 5.

However, the induction heating apparatus 250 using the same litz wire as the litz wire of the coil section of the excitation coil 253 as the harness 300 has a problem that the heating efficiency of the fixing belt 230 may decrease due to a power loss due to the resistance of this litz wire.

Thus, the fixing apparatus 200 using an image heating apparatus according to this embodiment specifies numerical values of various parameters of the litz wire as the harness 300 that supplies power to the excitation coil 253 of the induction heating apparatus 250 so that the resistance of the harness section becomes 0.008 Ω or less.

FIG. 6 illustrates a comparison of various parameters between the harness 300 used by the induction heating apparatus 250 of the image heating apparatus according to this embodiment and the conventional harness.

As shown in FIG. 6, both the harness in a conventional example and the harness 300 of this embodiment use a wire 300*a* having a length of the harness section (corresponding to two wires) of 1.2 m, a wire diameter of $150\times10^{-6}$ m, a wire cross-sectional area of $1.77\times10^{-8}$ $m^2$ and wire specific resistance of $1.81\times10^{-8}$ Ωm.

Furthermore, the harness in the conventional example is constructed of litz wire made of 40 stranded wires having a cross-sectional area of the harness section of $7.07\times10^{-7}$ $mm^2$. In contrast, the harness 300 of this embodiment is constructed of litz wire made of 160 stranded wires having a cross-sectional area of the harness section of $2.83\times10^{-6}$ $mm^2$.

Furthermore, the harness in the conventional example and the harness 300 of this embodiment have an effective harness current value (for 1200 W output) of 23.2 A.

The harness in the conventional example as structured above has a resistance of the harness section of 0.031 Ω and a harness section loss of 16.5 W. In contrast, the harness 300 of this embodiment has a resistance of the harness section of 0.008 Ω and can suppress a harness section loss to 4.1 W.

As a result, the fixing apparatus 200 using the harness 300 of this embodiment can obtain an effect of 9.0% reduction in a warm-up time.

Furthermore, the harness 300 used in the induction heating apparatus 250 of the image heating apparatus according to this Embodiment 1 is preferably constructed by stranding a plurality of wires 300*a* into one litz wire and further stranding a plurality of such litz wires. That is, the harness 300 of such a configuration can prevent noise.

Embodiment 2

Next, an image trbheating apparatus according to Embodiment 2 of the present invention will be explained. The image heating apparatus according to this Embodiment 2 has the same configuration as that of the aforementioned image heating apparatus according to Embodiment 1 except numerical values of various parameters of the aforementioned harness 300. Therefore, mainly the various parameters of the harness used in the induction heating apparatus of the image heating apparatus according to this Embodiment 2 will be explained here.

The numerical values of various parameters of the harness used in the induction heating apparatus of the image heating apparatus according to this Embodiment 2 are as follows:

(1) Length of harness section (corresponding to 2 wires) 1.2 m (2) Wire diameter: $150\times10^{-6}$ m (3) Wire cross section: $1.77\times10^{-8}$ $m^2$ (4) Number of wires: 80

(5) Harness cross section: $1.41\times10^{-6}$ $mm^2$ (6) Wire specific resistance: $1.81\times10^{-8}$ Ωm The effective harness current value used in the induction heating apparatus of the image heating apparatus according to this Embodiment 2 is 23.2 A.

According to the harness of the image heating apparatus according to Embodiment 2, the resistance of the harness section is 0.015 Ω and it is possible to suppress harness section loss to 8.3 W.

As a result, the fixing apparatus using this harness has a warm-up time of 14.6 sec and can thereby obtain the effect of reducing the warm-up time by 5.8%.

Embodiment 3

According to this embodiment, as shown in FIG. 2 and FIG. 3, the excitation coil 253 is constructed by alternately winding the coil wire 253*a* thereof around the coil support surface 251*a* of the support frame 251 so as to move along the axial direction of the heat generating roller 220. The length of the winding part of this excitation coil 253 is set to substantially the same length as the length of the area where the fixing belt 230 contacts the heat generating roller 220.

Figure 7:
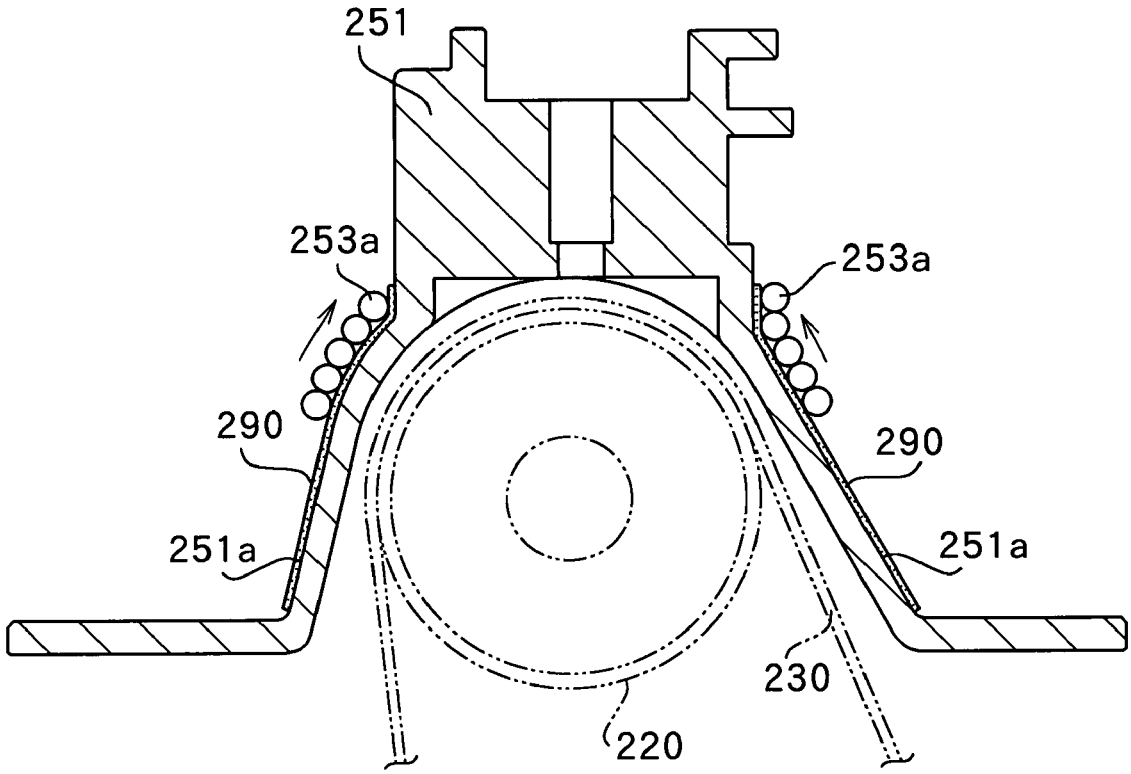
FIG. 7 is a schematic cross-sectional view illustrating a method of winding an excitation coil around a support frame as a coil support body of an induction heating apparatus according to Embodiment 3.

Here, as shown in FIG. 2 and FIG. 7, the support frame 251 wound with the excitation coil 253 is curved so as to cover the heat generating roller 220 and the coil support surface 251*a* wound with the coil wire 253*a* of the excitation coil 253 is curved and inclined.

For this reason, in the induction heating apparatus 250 in such as configuration, when the coil wire 253*a* is wound around the support frame 251, the coil wire 253*a* is likely to slide in the direction indicated by an arrow in FIG. 7, the coil wire 253*a* is likely to lift or disentangle causing mismatch of the excitation coil 253.

Thus, as shown in FIG. 7, the induction heating apparatus 250 according to this embodiment provides an adhesive layer 290 to adhesively hold the coil wire 253*a* to the coil support surface 251*a* of the support frame 251.

When the coil wire 253*a* is wound around the support frame 251, this induction heating apparatus 250 causes the coil wire 253*a* to be adhesively held to the coil support surface 251*a* through adhesion of the adhesive layer 290.

According to this induction heating apparatus 250, the coil wire 253*a* is adhesively held to the coil support surface 251*a* when the coil wire 253*a* is wound around the support frame 251, and therefore it is possible to prevent slippage or mismatch during the winding of the coil wire 253*a* and directly wind the coil wire 253*a* around the coil support surface 251*a*, thus saving time and trouble.

Figure 8:
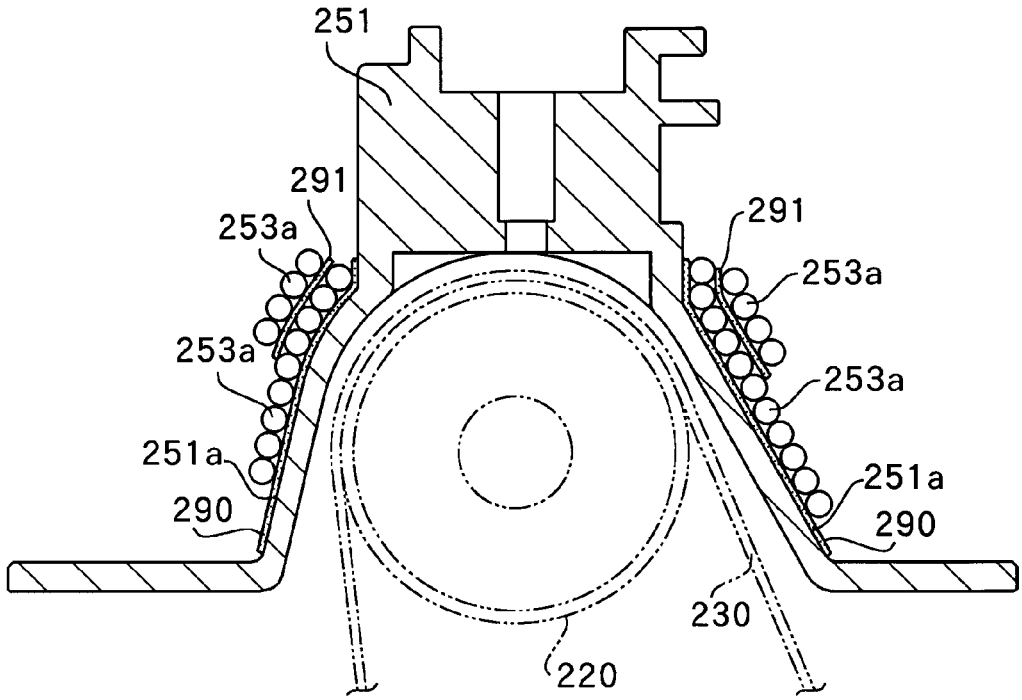
FIG. 8 is a schematic cross-sectional view illustrating a method of winding an upper layer coil wire around a lower layer coil wire wound around a support frame of an induction heating apparatus according to Embodiment 3.

Furthermore, as shown in FIG. 8, the induction heating apparatus 250 according to this embodiment further provides an intermediate adhesive layer 291 on the lower layer excitation coil 253 when the coil wire 253*a* is further wound around the lower layer coil wire 253*a* which has been wound around the support frame 251.

According to this induction heating apparatus 250, the upper layer coil wire 253*a* wound around the lower layer coil wire 253*a* is adhesively held to the lower layer coil wire 253*a* through adhesion of the intermediate adhesive layer 291.

This induction heating apparatus 250 ensures that the coil wire 253*a* of each layer is adhesively held to the support frame 251, and can thereby easily form the excitation coil 253 having a multilevel structure in which the coil is wound in multiple layers without any mismatch.

Figure 9:
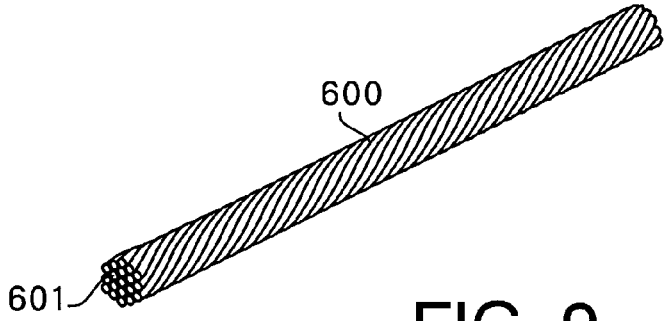
FIG. 9 is a schematic perspective view showing part of a litz wire used as the coil wire.

Here, as the above described coil wire 253*a*, as shown in FIG. 9, it is preferable to use a litz wire 600 formed by stranding several tens of wires 601. That is, since the coil wire 253*a* made of this litz wire 600 is easily bent, it is possible to wind the coil wire 253*a* around the coil support surface 251*a* of the support frame 251 easily and without wire breakage. Furthermore, the use of the litz wire 600 as the coil wire 253*a* makes it easy to get the adhesive layer 290 and intermediate adhesive layer 291 into gaps of the wires 601 making up the coil wire 253*a*, increases the area of contact between the coil wire 253*a*, and adhesive layer 290 and intermediate adhesive layer 291, increases adhesion holding power and can easily form the excitation coil without mismatch.

Figure 10:
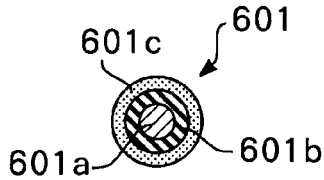
FIG. 10 is a schematic cross-sectional view showing the configuration of wires of the litz wire.

Furthermore, as shown in FIG. 10, it is preferable to use the wires 601 of the litz wire 600 made of a conductive wire 601*a* such as copper coated with an insulating coat 601*b* and with the insulating coat 601*b* further coated with a thermo-fusible fusion coat 601*c*.

With the excitation coil 253 formed of this litz wire 600, it is possible to easily form the excitation coil 253 without any mismatch by letting a current pass through the litz wire 600 and fusing/solidifying the fusion coat 601*c* with the litz wire 600 wound around the support frame 251.

Furthermore, as the adhesive layers 290, 291 which adhesively hold the coil wire 253*a*, any adhesive layers can be used if they have at least adhesive strength capable of keeping the winding shape of the coil wire 253*a* wound around the support frame 251. Such adhesive layers 290, 291 can prevent the coil wire 253*a* wound around the support frame 251 from disentangling, and can thereby further facilitate the operation of winding the coil wire 253*a* around the support frame 251. Furthermore, even if the induction heating apparatus 250 is removed from a jig such as a winding machine after the coil wire 253*a* is wound up, it is possible to prevent the coil wire 253*a* from disentangling and coming off the support frame 251 and easily form the excitation coil 253 without any mismatch.

As the adhesive for such adhesive layers 290, 291, it is preferable to use a heat-resistant and insulating acrylic or silicon-based adhesive. That is, when the excitation coil 253 is fed with a high frequency alternating current, if the excitation coil 253 is self-heated to a high temperature by the current resistance of the excitation coil 253, such an adhesive can keep necessary adhesion/holding power and thereby keep the shape of the excitation coil 253. Furthermore, since the adhesive layers 290, 291 have insulating properties, it is possible to prevent layer short, that is, partial short-circuit between neighboring wires or between layers of the excitation coil 253, which is likely to occur when there are pinholes or scars on the insulating coat 601*b* with which the wires 601 of the litz wire 600 are coated. For this purpose, it is effective to use an adhesive having a dielectric breakdown voltage of 10 kV/mm or above, or preferably 20 kV/mm or above for the adhesive layers 290, 291.

Furthermore, the thickness of the adhesive layers 290, 291 is preferably 50 μm to 200 μm. The adhesive layers 290, 291 having such a thickness can prevent disentangling of the coil wire 253*a* wound around the support frame 251 and form the excitation coil 253 with good magnetic coupling. That is, when the thickness of the adhesive layers 290, 291 is less than 50 μm, the adhesive strength is insufficient and the coil wire 253*a* wound around the coil support surface 251*a* is likely to disentangle. On the other hand, when the thickness of the adhesive layers 290, 201 exceeds 200 μm, the adhesion between the coil wires 253*a* is reduced, causing the magnetic coupling to deteriorate. When the thickness of the adhesive layers 290, 291 falls within the above described range, the dielectric breakdown voltage of the adhesive layers 290, 291 becomes 10 kV or above, and therefore it is possible to prevent layer short of the excitation coil 253.

Embodiment 4

Figure 11:
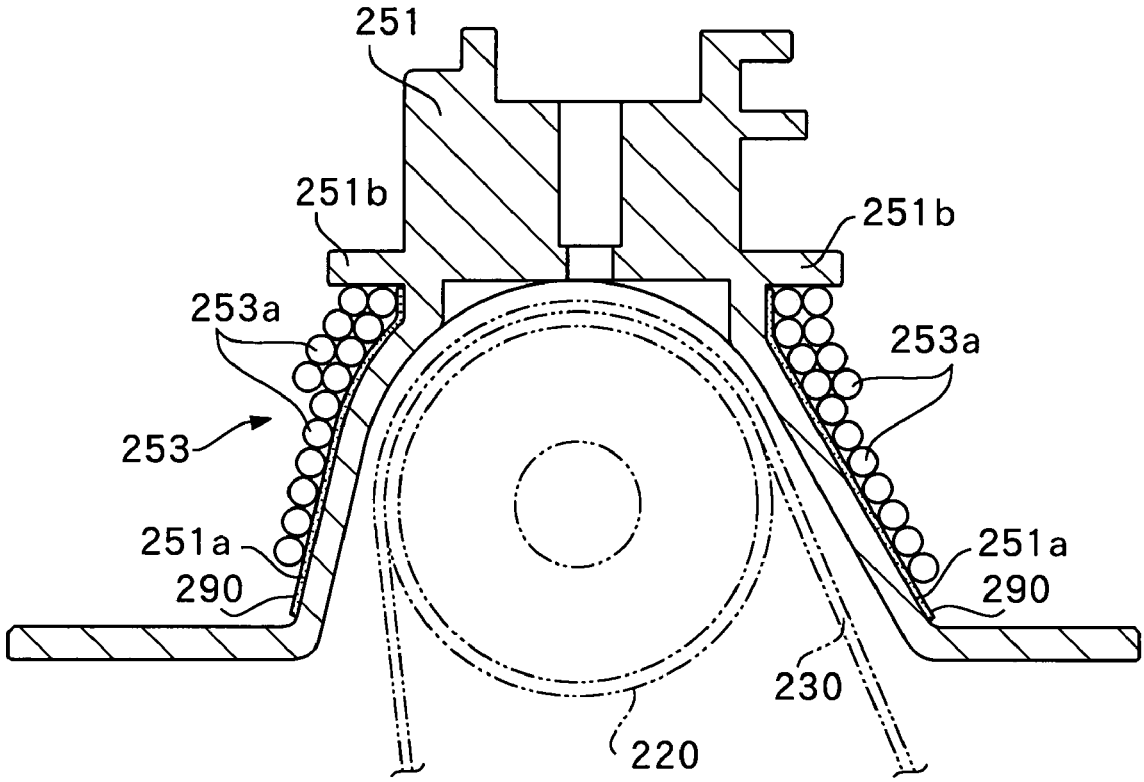
FIG. 11 is a schematic cross-sectional view showing the configuration of a coil support body of an induction heating apparatus according to Embodiment 4 of the present invention.

FIG. 11 is a schematic cross-sectional view showing the configuration of a coil support body of an induction heating apparatus according to this embodiment.

As described above, in the induction heating apparatus 250, when the coil wire 253*a* is wound around the support frame 251, the coil wire 253*a* is likely to slide in the direction indicated by the arrow in FIG. 7.

Thus, as shown in FIG. 11, the induction heating apparatus 250 according to this embodiment forms a convex section 251*b* at one end of the coil support surface 251*a* of the support frame 251 as the coil support body closer to the center (top in the figure) of the winding of the excitation coil 253.

According to this induction heating apparatus 250, the convex section 251*b* formed at the end of the coil support surface 251*a* prevents the coil wire 253*a* wound around the support frame 251 from sliding, and it is thereby possible to wind the coil wire 253*a* around the coil support surface 251*a* more easily and more densely.

The convex section 251*b* may have a shape either continuously protruding along the longitudinal direction of the support frame 251 or protruding at predetermined intervals.

Furthermore, the induction heating apparatus 250 according to this embodiment can prevent the coil wire 253*a* from sliding because of the convex section 251*b* without the need to provide the aforementioned adhesive layers 290, 291, but it is desirable to provide the adhesive layers 290, 291 to prevent mismatch or disentangling of the winding of the coil wire 253*a*.

Furthermore, the convex section 251*b* may also be attached to the support frame 251 as a separate member, but it is desirable to form it integral with the support frame 251 from the standpoint of cost reduction.

Embodiment 5

Figure 12:
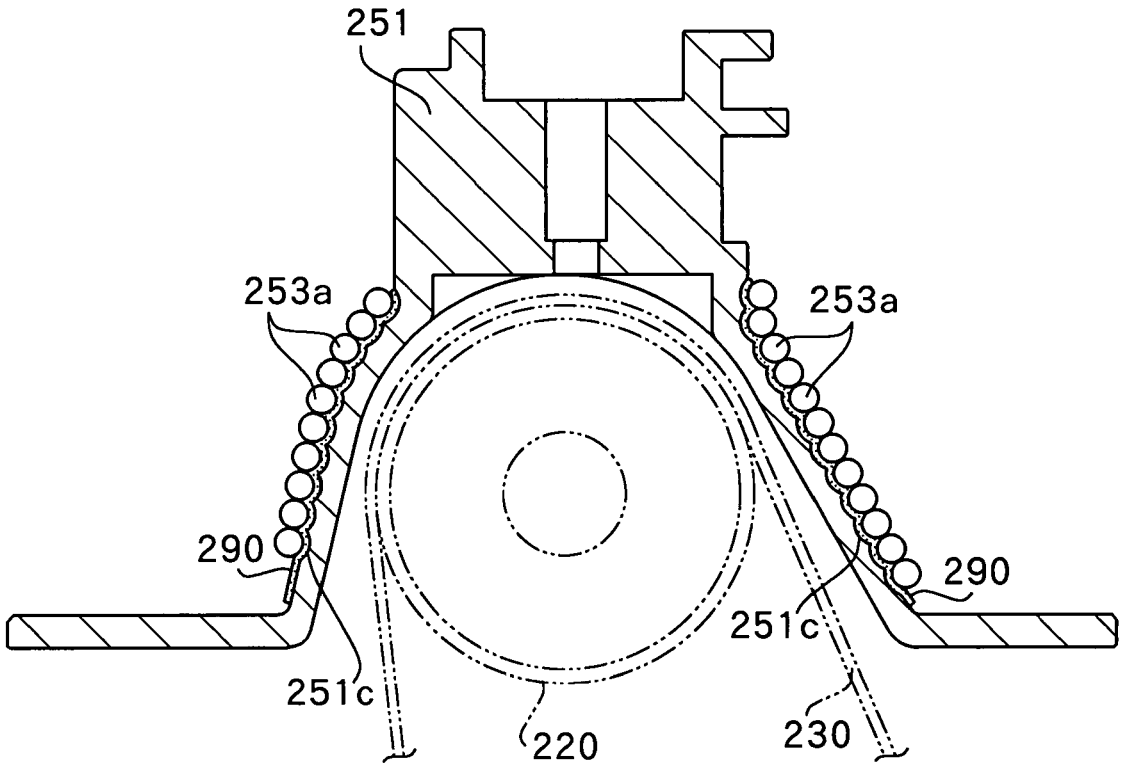
FIG. 12 is a schematic cross-sectional view showing the configuration of a coil support body of an induction heating apparatus according to Embodiment 5 of the present invention.

FIG. 12 is a schematic cross-sectional view showing the configuration of a coil support body of an induction heating apparatus according to this embodiment.

As shown in FIG. 12, the induction heating apparatus 250 according to this embodiment forms an undulate engagement groove 251*c* which engages with the coil wire 253*a* on the coil support surface 251*a* (see FIG. 7) of the support frame 251 of the induction heating apparatus 250 according to Embodiment 4.

According to this induction heating apparatus 250, when the coil wire 253*a* is wound around the aforementioned coil support surface 251*a*, the coil wire 253*a* engages with the engagement groove 251*c* formed in this coil support surface 251*a*. Then, the engagement of the coil wire 253*a* with the engagement groove 251*c* prevents the coil wire 253*a* wound around the support frame 251 from sliding.

Therefore, this induction heating apparatus 250 allows the coil wire 253*a* to be wound around the aforementioned coil support surface 251*a* more easily.

The engagement groove 251*c* may also have a shape either continuously protruding along the longitudinal direction of the support frame 251 or protruding at predetermined intervals.

Furthermore, the induction heating apparatus 250 according to this embodiment can prevent the coil wire 253*a* from sliding by means of the engagement groove 251*c* without the need to provide the aforementioned adhesive layers 290, 291, but it is desirable to provide the adhesive layers 290, 291 to prevent mismatch or disentangling of the winding of the coil wire 253*a*.

Furthermore, the engagement groove 251*c* may also be attached to the support frame 251 as a separate member, but it is desirable to form it integral with the support frame 251 from the standpoint of cost reduction.

Furthermore, the manufacturing steps of the induction heating apparatus 250 according to this embodiment include the following coil winding step. That is, an adhesive layer having adhesive strength capable of keeping the winding shape of the coil wire is provided on the coil support surface of the coil support body which supports the excitation coil wound with a conductive coil wire and the coil wire is wound around the adhesive layer.

The present invention is not limited to the above described embodiments, and various variations and modifications may be possible without departing from the scope of the present invention.

This application is based on the Japanese Patent Applications No. 2004-089767 filed on Mar. 25, 2004, No. 2004-70261 filed on Mar. 12, 2004, entire content of which are expressly incorporated by reference herein.

What is claimed is:

1. An image heating apparatus for heating an unfixed image on a recording medium, comprising:

an image heating body that contacts under pressure the recording medium on which the unfixed image is formed;

an induction-heating section having an excitation coil that induction-heats said image heating body;

a feeder circuit that supplies power to said excitation coil; and a harness that electrically connects said excitation coil and said feeder circuit, wherein said harness comprises a conductive wire having a power loss characteristic lower than a power loss characteristic of a wire which forms said excitation coil.

2. The image heating apparatus according to claim 1, wherein said harness is a conductive wire made of the same material as said excitation coil, and has a cross-sectional area larger than a cross-sectional area of said excitation coil.

3. The image heating apparatus according to claim 2, wherein the conductive wire of said harness is a litz wire and the number of wires of the litz wire of said harness is at least double a number of wires of a litz wire of a coil section of said excitation coil.

4. A fixing apparatus for heating/fixing an unfixed image on a recording medium, comprising the image heating apparatus according to claim 1 that heats an unfixed image on a recording medium.

5. An image formation apparatus for forming an unfixed image on a recording medium, comprising the fixing apparatus according to claim 4.

6. The image heating apparatus according to claim 1, wherein said excitation coil is formed by winding a conductive coil wire, said image heating apparatus further comprises a coil support body that has a coil support surface for supporting said excitation coil and an adhesive layer for adhesively holding said coil wire wound around said coil support surface.

7. The image heating apparatus according to claim 6, further comprising an intermediate adhesive layer that adhesively fixes an upper layer coil wire wound around a lower layer coil wire wound around said coil support body.

8. The image heating apparatus according to claim 6, wherein said coil wire is made of a litz wire formed by stranding a plurality of wires.

9. The image heating apparatus according to claim 8, wherein the wires of said litz wire are made of conductive wires coated with an insulating coat and said insulating coat is further coated with a thermofusible fusion coat.

10. The image heating apparatus according to claim 6, wherein said adhesive layer has adhesive strength capable of keeping a winding shape of said coil wire wound around said coil support body.

11. The image heating apparatus according to claim 10, wherein an adhesive of said adhesive layer is made of an acrylic or silicon-based adhesive having heat-resistant and insulating properties.

12. The image heating apparatus according to claim 11, wherein said adhesive has a dielectric breakdown voltage of 10 kV/mm or above.

13. The image heating apparatus according to claim 6, wherein said adhesive layer has a thickness of 50 ÿm to 200 ÿm.

14. The image heating apparatus according to claim 6, wherein the coil support surface of said coil support body is made up of an inclined surface and a convex section is formed at one end of said coil support surface closer to a center of the winding of said excitation coil.

15. The image heating apparatus according to claim 6, wherein an undulate engagement groove for engaging with said coil wire is formed on the coil support surface of said coil support body when said coil wire is wound around said coil support body.

* * * * *